US009472149B2

(12) United States Patent
Shin et al.

(10) Patent No.: US 9,472,149 B2
(45) Date of Patent: Oct. 18, 2016

(54) DISPLAY APPARATUS

(71) Applicant: SAMSUNG DISPLAY CO., LTD., Yongin, Gyeonggi-Do (KR)

(72) Inventors: YongHwan Shin, Yongin-si (KR); Hoi-Lim Kim, Seoul (KR); Hongyeon Lee, Seoul (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 183 days.

(21) Appl. No.: 14/300,386

(22) Filed: Jun. 10, 2014

(65) Prior Publication Data

US 2015/0116374 A1 Apr. 30, 2015

(30) Foreign Application Priority Data

Oct. 30, 2013 (KR) ..... 10-2013-0130432

(51) Int. Cl.
*G09G 5/10* (2006.01)
*G09G 3/36* (2006.01)
*G09G 3/00* (2006.01)

(52) U.S. Cl.
CPC ..... *G09G 3/3648* (2013.01); *G09G 3/003* (2013.01); *G09G 2300/023* (2013.01); *G09G 2320/0252* (2013.01); *G09G 2320/0285* (2013.01); *G09G 2340/16* (2013.01)

(58) Field of Classification Search
CPC .... G09G 3/36; G09G 3/3607; G09G 3/3648; G09G 3/3696; G09G 3/003; G09G 2300/023; G09G 2320/06; G09G 2320/0252; G09G 2320/0285; G09G 2340/16
USPC ..... 345/87–104, 690
See application file for complete search history.

(56) References Cited

U.S. PATENT DOCUMENTS

| | | | | |
|---|---|---|---|---|
| 6,115,100 | A | 9/2000 | Koma | |
| 2004/0105038 | A1 | 6/2004 | Hashimoto et al. | |
| 2008/0106689 | A1 | 5/2008 | Inoue et al. | |
| 2008/0259258 | A1 | 10/2008 | Hashimoto et al. | |
| 2010/0015718 | A1 | 1/2010 | Ah et al. | |
| 2012/0236043 | A1* | 9/2012 | Jung | G02B 27/2214 345/690 |
| 2013/0077013 | A1* | 3/2013 | Yamazaki | G02B 3/14 349/57 |
| 2013/0222713 | A1* | 8/2013 | Park | G02B 27/2264 349/15 |

FOREIGN PATENT DOCUMENTS

| | | | |
|---|---|---|---|
| JP | 11-223807 | A | 8/1999 |
| JP | 2003-215620 | A | 7/2003 |
| JP | 2005-284304 | A | 10/2005 |
| JP | 2009-180951 | A | 8/2009 |
| KR | 10-2003-0005748 | A | 1/2003 |
| KR | 10-2006-0043389 | A | 5/2006 |

* cited by examiner

*Primary Examiner* — Jimmy H Nguyen
(74) *Attorney, Agent, or Firm* — Lee & Morse, P.C.

(57) ABSTRACT

A display apparatus includes a display panel having a first liquid crystal layer, a timing controller that converts image signals to have gray scales corresponding to a first reference value, and compensates the converted image signals to over-drive the first liquid crystal layer, the first reference value being a product of a refractive index anisotropy and a thickness of the first liquid crystal layer, a first driver that converts the compensated image signals to voltages that drive the first liquid crystal layer, a liquid crystal lens panel including a second liquid crystal layer, a liquid crystal lens controller that generates lens signals corresponding to a second reference value defined by a product of a refractive index anisotropy and a second thickness of the second liquid crystal layer, and a second driver that convert the lens signals to voltages that drive the second liquid crystal layer.

17 Claims, 9 Drawing Sheets

DISPLAY APPARATUS

CROSS-REFERENCE TO RELATED APPLICATION

Korean Patent Application No. 10-2013-0130432, filed on Oct. 30, 2013, in the Korean Intellectual Property Office, and entitled: "DISPLAY APPARATUS," is incorporated by reference herein in its entirety.

BACKGROUND

1. Field

The present disclosure relates to a display apparatus. More particularly, the present disclosure relates to a display apparatus capable of improving a response speed.

2. Description of the Related Art

In general, a display apparatus includes a first substrate including a plurality of pixels formed thereon, a second substrate facing the first substrate and including a common electrode formed thereon, and a liquid crystal layer interposed between the first substrate and the second substrate. An electric field is formed between a pixel electrode and the common electrode by a voltage difference between a data voltage applied to the pixel electrode and a common voltage applied to the common electrode. Due to the electric field formed between the pixel electrode and the common electrode, liquid crystal molecules in the liquid crystal layer are driven. As a result, an amount of light passing through the liquid crystal layer is changed and a desired image is displayed.

In recent years, demand for a technology to improve the response speed of the liquid crystal molecules in the liquid crystal layer keeps on increasing.

SUMMARY

The present disclosure provides a display apparatus capable of improving a response speed.

Embodiments provide a display apparatus including a display panel including a first liquid crystal layer, the display panel being configured to generate an image, a timing controller configured to convert image signals to have gray scales corresponding to a first reference value, and to compensate the converted image signals to over-drive the first liquid crystal layer, the first reference value being defined by a product of a refractive index anisotropy of a first liquid crystal of the first liquid crystal layer and a first thickness of the first liquid crystal layer, a first driver configured to convert the compensated image signals to data voltages, and to apply the data voltages to the first liquid crystal layer to drive the first liquid crystal layer, a liquid crystal lens panel including a second liquid crystal layer configured to receive the image and to refract the image, a liquid crystal lens controller configured to generate lens data signals using data values corresponding to a second reference value, the second reference value being defined by a product of a refractive index anisotropy of a second liquid crystal of the second liquid crystal layer and a second thickness of the second liquid crystal layer, and a second driver configured to convert the lens data signals to lens data voltages and to apply the lens data voltages to the second liquid crystal layer to drive the second liquid crystal layer.

The first reference value and the second reference value may be set using refractive index anisotropies of liquid crystal and thicknesses of liquid crystal layer, which exist between a first maximum value and a fifth maximum value of a sine wave of a light transmittance according to a variation of Δnd in an equation of Equation $$I \propto \sin 2((\pi \Delta n d)/\lambda),$$

where I denotes the light transmittance, Δn denotes a refractive index anisotropy of the liquid crystal, d denotes the thickness of the liquid crystal layer, λ denotes a wavelength of the light, the Δn is obtained by subtracting "no" from "ne" (Δn=ne−no), ne denotes a refractive index in a long axis of liquid crystal molecules, and no denotes a refractive index in a short axis of the liquid crystal molecules.

The gray scale values corresponding to the first reference value may correspond to driving voltages in a period in which the light transmittance rises from a minimum value to a maximum value in a relation between the light transmittance and the driving voltages according to the first reference value.

The timing controller may include a data converter that converts the image signals such that the image signals have the gray scale values corresponding to the first reference value, a frame memory that stores the converted image signals of a previous frame, and a data compensator that compares first gray scale values of the converted image signals in a present frame with second gray scale values of the converted image signals of the previous frame to compensate the first gray scale values. The data compensator may compensate the gray scale values when a difference value between the first gray scale values and the second gray scale values is greater than a predetermined reference value.

The data converter may include a first look-up table to store the gray scale values corresponding to the first reference value.

The display panel may further include a first substrate that includes a plurality of pixels including a plurality of pixel electrodes and a second substrate disposed to face the first substrate and including a first common electrode. The first liquid crystal layer may be disposed between the first substrate and the second substrate, the data voltages are applied to the pixel electrodes, and the first common electrode is applied with a first common voltage having a predetermined direct current voltage level.

The first driver may include a gate driver that generates gate signals and a data driver that converts the compensated image signals to the data voltages, and the pixels receive the data voltages in response to the gate signals.

The data voltages corresponding to the second reference value may correspond to the driving voltages in a period in which the light transmittance rises from a minimum value to a maximum value in a relation between the light transmittance and the driving voltages according to the second reference value.

The liquid crystal lens controller may include a second look-up table to store the data values corresponding to the second reference value.

The display apparatus may further include a voltage generator that generates a second common voltage applied to the liquid crystal lens panel by using the first common voltage and the control of the liquid crystal lens controller.

The lens driving voltages may have a polarity inverted every frame and the second common voltage has an opposite polarity to the lens driving voltages.

A difference value between the second common voltage and the lens driving voltage may be larger than a difference value between the first common voltage and the lens driving voltage in every frame.

An absolute value of the lens driving voltages may be equal to an absolute value of the second common voltage.

The liquid crystal lens panel may further include a third substrate that includes a plurality of first electrodes and a plurality of second electrodes alternately arranged with and disposed on a different layer from the first electrodes and a fourth substrate disposed to face the third substrate and including a second common electrode. The second liquid crystal layer may be disposed between the third substrate and the fourth substrate, the first and second electrodes are applied with the lens driving voltages, and the second common electrode is applied with the second common voltage.

BRIEF DESCRIPTION OF THE DRAWINGS

Features will become apparent to those of ordinary skill in the art by describing in detail exemplary embodiments with reference to the attached drawings, in which.

DETAILED DESCRIPTION

Figure 1:
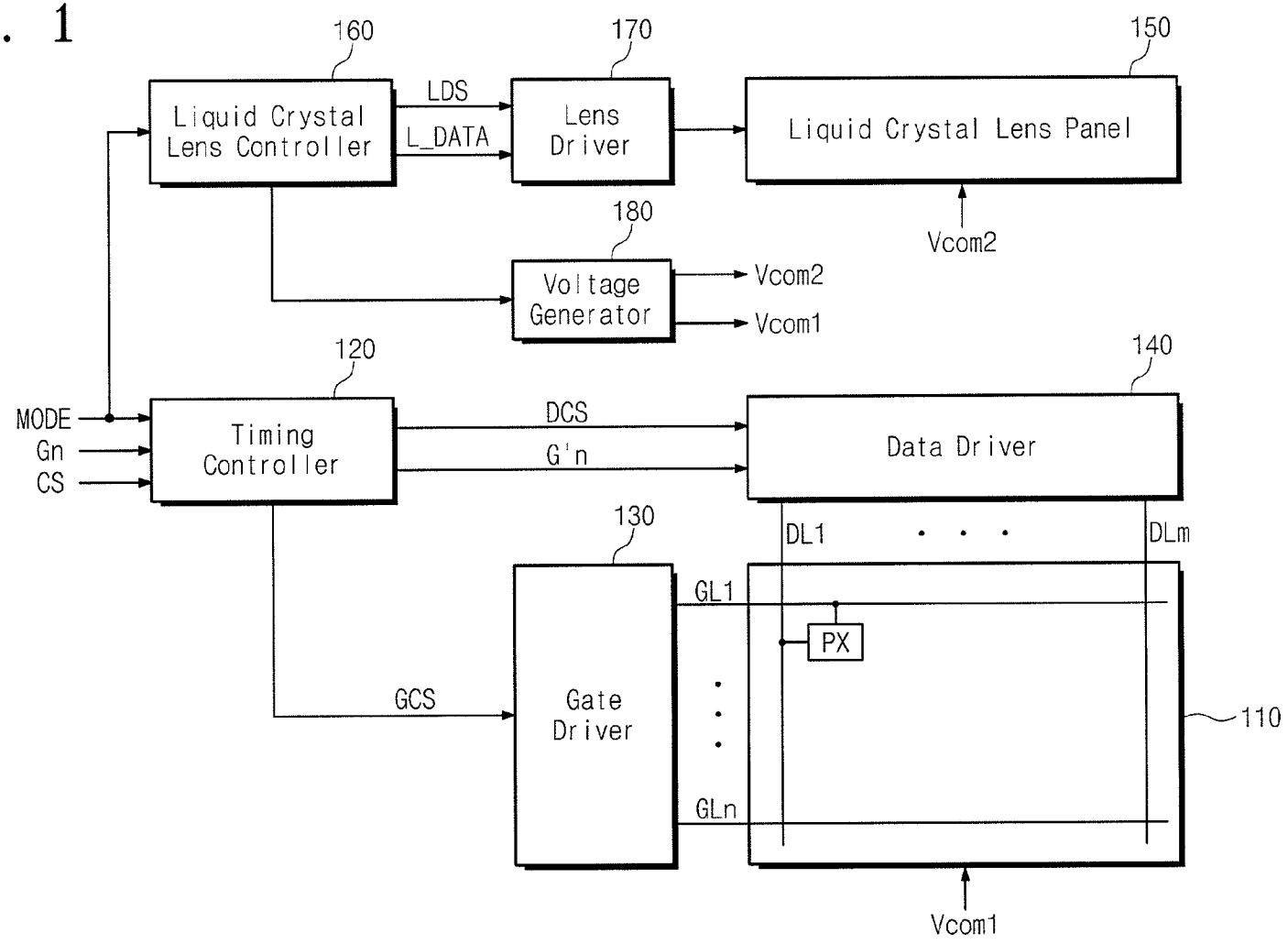
FIG. 1 illustrates a block diagram of a display apparatus according to an exemplary embodiment of the present disclosure.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

It will be understood that when an element or layer is referred to as being "on", "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments will be explained in detail with reference to the accompanying drawings.

Figure 2:
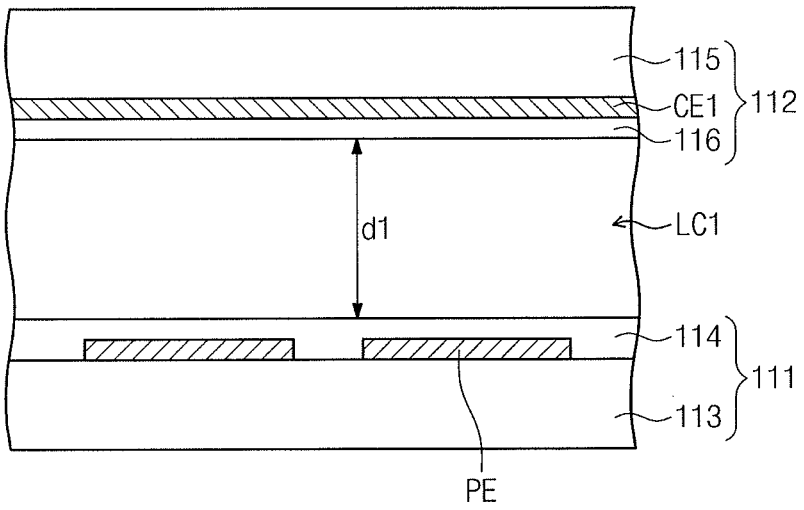
FIG. 2 illustrates a cross-sectional view of a display panel shown in FIG. 1.

FIG. 1 is a block diagram showing a display apparatus according to an exemplary embodiment of the present disclosure, and FIG. 2 is a cross-sectional view showing a display panel shown in FIG. 1. For the convenience of explanation, FIG. 2 shows a portion of a display panel 110.

Referring to FIG. 1, a display apparatus 100 may include the display panel 110, a timing controller 120, a gate driver 130, a data driver 140, a liquid crystal lens panel 150, a liquid crystal lens controller 160, a lens driver 170, and a voltage generator 180.

The gate driver 130 and the data driver 140 may be referred to as a first driver to drive the display panel 110. That is, the first driver includes the gate driver 130 and the data driver 140. The lens driver 170 may be referred to as a second driver.

The display panel 110 may include a plurality of gate lines GL1 to GLn, a plurality of data lines DL1 to DLm, and a plurality of pixels PX arranged in a matrix form. The gate lines GL1 to GLn are arranged to cross the data lines DL1 to DLm, and are insulated from the data lines DL1 to DLm. Each pixel PX is connected to a corresponding gate line of the gate lines GL1 to GLn and to a corresponding data line of the data lines DL1 to DLm.

The gate lines GL1 to GLn extend in a row direction and are connected to the gate driver 130. The gate lines GL1 to GLn sequentially receive gate signals from the gate driver 130.

The data lines DL1 to DLm extend in a column direction and are connected to the data driver 140. The data lines DL1 to DLm sequentially receive data signals from the data driver 140.

The timing controller 120 receives a mode signal MODE, image signals Gn, and a control signal CS from an external source (not shown), e.g., a system board. The mode signal MODE includes a two-dimensional (2D) mode signal and a three-dimensional (3D) mode signal. The image signals Gn include a two-dimensional (2D) image signal and a three-dimensional (3D) image signal.

When the display apparatus 100 displays a 2D image, the timing controller 120 receives the 2D mode signal and the 2D image signal from the external source. When the display apparatus 100 displays a 3D image, the timing controller 120 receives the 3D mode signal and the 3D image signal from the external source.

The timing controller 120 converts a data format of the image signals Gn to a data format appropriate to an interface between the data driver 140 and the timing controller 120. The timing controller 120 applies the image signals G'n having the converted data format to the data driver 140.

The timing controller 120 generates a gate control signal GCS and a data control signal DCS in response to the control signal CS. The gate control signal GCS is used to control an operation timing of the gate driver 130. The data control signal DCS is used to control an operation timing of the data driver 140. The timing controller 120 applies the gate control signal GCS to the gate driver 130 and the data control signal DCS to the data driver 140.

The gate driver 130 outputs the gate signals in response to the gate control signal GCS. The data driver 140 converts the image signals G'n to the data voltages in response to the data control signal DCS and outputs the data voltages. The data voltages correspond to gray scales of the image signals G'n.

The gate signals are applied to the pixels PX through the gate lines GL1 to GLn in the unit of row. The data voltages are applied to the pixels PX through the data lines DL1 to DLm. The pixels PX receive the data voltages in response to the gate signals and display gray scales corresponding to the data voltages.

The timing controller 120 controls the display panel 110 to display the 2D image or the 3D image in response to the mode signal MODE. For instance, when the mode signal MODE indicates the 2D mode signal, the timing controller 120 generates the gate control signal GCS and the data control signal DCS, which are required to display the 2D image. In this case, the gate driver 130 and the data driver 140 drive the display panel 110 in response to the gate control signal GCS and the data control signal DCS such that the display panel 100 displays the 2D image. Accordingly, the display panel 100 displays the 2D image every frame.

When the mode signal MODE indicates the 3D mode signal, the timing controller 120 generates the gate control signal GCS and the data control signal DCS, which are required to display the 3D image. In this case, the gate driver 130 and the data driver 140 drive the display panel 110 in response to the gate control signal GCS and the data control signal DCS such that the display panel 110 displays the 3D image.

The 3D image signal includes a left-eye image signal and a right-eye image signal. The display panel 110 repeatedly displays left-eye and right-eye images every frame, and thus the 3D image is displayed in the display panel 110.

The liquid crystal lens panel 150 is operated in the 2D mode or the 3D mode. When the display panel 110 displays the 2D image, the liquid crystal lens panel 150 transmits the image light from the display panel 110 without substantial alteration. Therefore, the 2D image is provided to a viewer.

When the display panel 110 displays the 3D image, the liquid crystal lens panel 150 serves as a Fresnel lens. The image light exiting from the display panel 110 includes the left-eye image and the right-eye image. The left-eye image and the right-eye image generated by the display panel 110 are refracted by the liquid crystal lens panel 150, which serves as the Fresnel lens, and are provided to the viewer. Thus, the 3D image is provided to the viewer.

The liquid crystal lens controller 160 drives the lens driver 170 in the 2D mode in response to the 2D mode signal. Accordingly, the lens driver 170 controls the liquid crystal lens panel 150 to transmit the 2D image.

The liquid crystal lens controller 160 generates a lens control signal LDS in response to the 3D mode signal, which is used to drive the liquid crystal lens panel 150 as the Fresnel lens. The lens driver 170 drives the liquid crystal lens panel 150 as the Fresnel lens in response to the lens control signal LDS. Although not shown in figures, the liquid crystal lens panel 150 includes a plurality of unit lens, each of which is operated as the Fresnel lens.

The voltage generator 180 generates a first common voltage Vcom1 and a second common voltage Vcom2. The voltage generator 180 generates the second common voltage Vcom2 by the control of the liquid crystal lens controller 160 when the liquid crystal lens panel 150 is operated as the Fresnel lens. The first common voltage Vcom1 is applied to the display panel 110 and the second common voltage Vcom2 is applied to the liquid crystal lens panel 150.

The pixels PX of the display panel 110 receive the first common voltage Vcom1 and the data voltages to display the image. The liquid crystal lens panel 150 receives the second common voltage Vcom2 and lens driving voltages, and is operated as the Fresnel lens.

Referring to FIG. 2, the display panel 110 may include a first substrate 111, a second substrate 112, and a first liquid crystal layer LC1 interposed between the first substrate 111 and the second substrate 112. Therefore, the display panel 110 may be referred to as a liquid crystal display panel 110.

The first liquid crystal layer LC1 has a first thickness d1 corresponding to a distance d1 between the first substrate 111 and the second substrate 112. Although not shown in the figures, the first liquid crystal layer LC1 may include a plurality of first liquid crystal molecules.

The first substrate 111 may include a first base substrate 113, a plurality of pixel electrodes PE, and a first insulating layer 114. The pixel electrodes PE correspond to the pixels PX, respectively, and are disposed on the first base substrate 113. The first insulating layer 114 is disposed on the first base substrate 113 to cover the pixel electrodes PE.

Although not shown in the figures, the first substrate 111 may include thin film transistors corresponding to the pixels PX in a one-to-one correspondence. That is, each of the pixels PX includes a thin film transistor and a pixel electrode PE. The thin film transistor is connected to a corresponding gate line of the gate lines GL1 to GLn, a corresponding data line of the data lines DL1 to DLm, and a corresponding pixel electrode of the pixel electrodes PE.

The thin film transistor is turned on in response to the gate signal provided through the corresponding gate line. The turned-on thin film transistor receives the data voltage provided through the corresponding data line. The thin film transistor applies the data voltage to the corresponding pixel electrode PE.

The second substrate 112 may include a second base substrate 115, a first common electrode CE1, and a second insulating layer 116. The first common electrode CE1 is disposed on the second base substrate 115. The second insulating layer 116 is disposed on the first common electrode CE1. The first common electrode CE1 is applied with the first common voltage Vcom1. The first common voltage Vcom1 has a predetermined direct current voltage level.

Due to the voltage difference between the data voltage applied to the pixel electrodes PE and the first common voltage Vcom1 applied to the first common electrode CE1, an electric field is formed between the first common electrode CE1 and the pixels PE. The first liquid crystal molecules in the first liquid crystal layer LC1 are driven by the electric field formed between the first common electrode CE1 and the pixel electrodes PE. As a result, transmittance of the light passing through the first liquid crystal layer LC1 is changed, and thus an image is displayed.

Although not shown in the figures, the display apparatus 100 may include a backlight unit disposed at a rear side of the display panel 110 to provide the display panel 110 with the light.

A response speed of the display panel 110 is determined depending on a response speed of a first liquid crystal, and the response speed of the first liquid crystal is determined depending on a response speed of the first liquid crystal molecules. The response speed of the first liquid crystal is changed depending on a refractive index anisotropy Δn1 of the first liquid crystal and the first thickness d1 of the first liquid crystal layer LC1. The refractive index anisotropy Δn1 of the first liquid crystal is determined by a difference between a refractive index ne1 in a long axis direction of the first liquid crystal molecules and a refractive index no1 in a short axis direction of the first liquid crystal molecules.

A value obtained by multiplying the refractive index anisotropy Δn1 of the first liquid crystal by the first thickness d1 of the first liquid crystal layer LC1 is referred to as a first reference value Δn1d1. That is, the first reference value may be represented by Δn1d1.

The timing controller 120 converts the image signals Gn to image signals corresponding to the first reference value Δn1d1. The first reference value Δn1d1 is set to improve the response speed of the display panel 110. This will be described in detail later.

Figure 3:
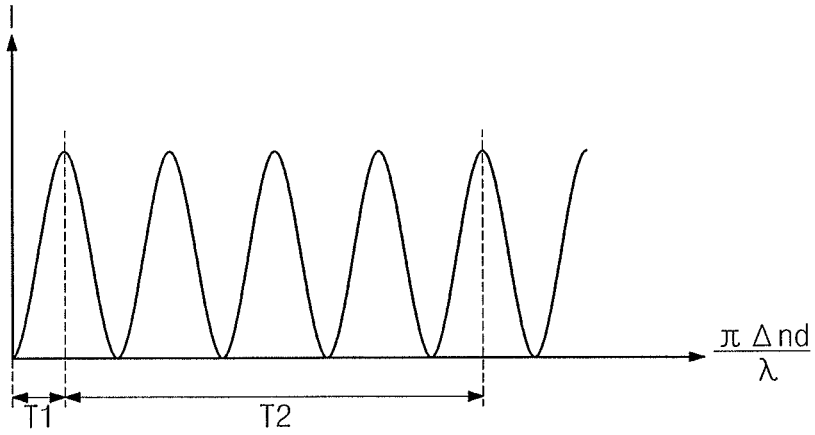
FIG. 3 illustrates a graph of light transmittance of a conventional liquid crystal layer.

FIG. 3 is a graph showing light transmittance of a conventional liquid crystal layer.

In general, light transmittance (or brightness) of light passing through a liquid crystal layer is represented by the following Equation 1.

$$I=\sin^2(2\theta)\sin^2((\pi\Delta nd)/\lambda) \qquad \text{Equation 1}$$

In Equation 1, I denotes light transmittance of the liquid crystal layer, Δn denotes a refractive index anisotropy of liquid crystal molecules of the liquid crystal layer, d denotes a thickness (or a cell gap) of the liquid crystal layer, and λ denotes a wavelength of the light. The refractive index anisotropy Δn is obtained by subtracting "no" from "ne" (Δn=ne−no), "ne" denotes a refractive index in a long axis of the liquid crystal molecules, and "no" denotes a refractive index in a short axis of the liquid crystal molecules.

In addition, θ denotes an alignment angle of an optical axis of the liquid crystal molecules with respect to a polarization axis of a polarization plate (not shown). The alignment angle of the optical axis of the liquid crystal molecules is previously set. For instance, when the optical axis of the liquid crystal molecules is aligned at an angle of about 45 degrees with respect to the polarization axis of the polarization plate, θ becomes 45 degrees (θ=45°). In this case, the transmittance I of the light passing through the liquid crystal layer becomes "$\sin^2((\pi\Delta n)/\lambda)$".

That is, since "$\sin^2(2\theta)$" is a fixed number, the transmittance I of the light passing through the liquid crystal layer may be represented by a sinusoidal function as the following Equation 2.

$$I\propto \sin^2((\pi\Delta nd)/\lambda) \qquad \text{Equation 2}$$

According to the above-mentioned Equation 2, the light transmittance is determined by the value obtained by multiplying the refractive index anisotropy Δn of the liquid crystal molecules by the thickness d of the liquid crystal layer. The refractive index anisotropy Δn and the thickness d are larger than zero (0). Accordingly, a graph of the sinusoidal function of the light transmittance I according to Equation 2 may be represented as shown in FIG. 3.

In FIG. 3, a period in an X-axis smaller than a first maximum value of the light transmittance I is referred to as a first period T1. That is, the first period T1 corresponds to a period of (πΔn)/λ values corresponding to the values of the light transmittance I, which are smaller than the first maximum value of the light transmittance I.

In addition, a period in the X-axis between the first maximum value and a fifth maximum value of the light transmittance I is referred to as a second period T2. That is, the second period T2 corresponds to a period of (πΔn)/λ values corresponding to the values of the light transmittance I between the first maximum value of the light transmittance I and the fifth maximum value of the light transmittance I.

A conventional Δnd value has a value among Δnd values corresponding to the first period T1, but the first reference value Δn1d1 has a value among Δnd values corresponding to the second period T2. That is, the first reference value Δn1d1 is set using the refractive index anisotropies Δn of the liquid crystal molecules and the thicknesses d of the liquid crystal layer between the first maximum value and the fifth maximum value of a sine wave of the light transmittance I according to the variation of Δnd in Equation 2.

For instance, the (πΔn)/λ values that allow the light transmittance I to have the value between the first maximum value and the fifth maximum value exist in the second period T2. The Δn value of any one (πΔn)/λ value among the (πΔn)/λ values existing in the second period T2 may be set to the first reference value Δn1d1. That is, any one value among the values obtained by multiplying the refractive index anisotropies Δn of the liquid crystal molecules by the thicknesses d in the liquid crystal layer may be set to the value obtained by the refractive index anisotropy Δn1 of the first liquid crystal by the first thickness d1 of the first liquid crystal layer LC1.

Figure 4:
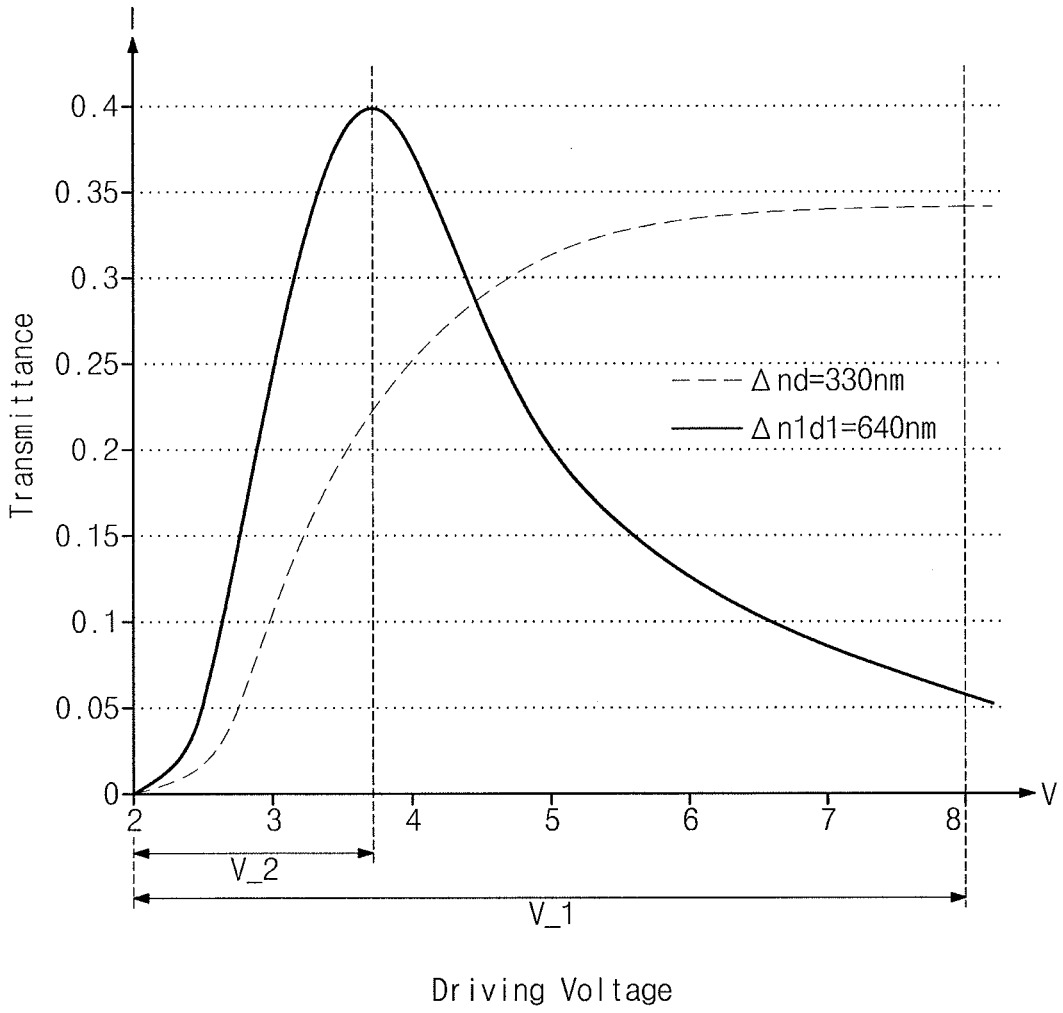
FIG. 4 illustrates a graph of light transmittance as a function of a voltage in the display apparatus according to an exemplary embodiment and in a conventional display apparatus.

FIG. 4 is a graph showing the light transmittance as a function of the voltage in the display apparatus according to an exemplary embodiment of the present disclosure and in a conventional display apparatus.

In FIG. 4, an X-axis represents the driving voltage V required to drive the liquid crystal and a Y-axis represents the light transmittance I. A graph indicated by a dotted line in FIG. 4 shows a relation between the light transmittance and the driving voltage according to the conventional Δnd value and a graph indicated by a solid line in FIG. 4 shows a relation between the light transmittance and the driving voltage according to the first reference value Δn1d1 of the present disclosure.

In FIG. 4, the Δnd value of about 330 nm corresponds to any one Δnd value among the Δnd values in the first period T1 shown in FIG. 3, and the Δn1d1 value of about 640 nm corresponds to any one Δnd value among the Δnd values in the second period T2 shown in FIG. 3. That is, the first reference value Δn1d1 of the present exemplary embodiment is set to about 640 nm.

As an example, when the first reference value Δn1d1 is about 640 nm, the refractive index anisotropy Δn1 of the first liquid crystal is about 0.2 and the first thickness d1 of the first liquid crystal layer LC1 is about 3.2 micrometers, but they should not be limited thereto or thereby.

When the Δnd value is about 330 nm, the light transmittance I starts to increase at a point when the driving voltage is about 2 volts and stops increasing when the driving voltage is about 8 volts. Therefore, when the Δnd value is about 330 nm, the driving voltage of about 2 volts to about 8 volts in a first voltage period V_1 is required to drive the liquid crystal molecules of the liquid crystal layer.

When the Δn1d1 value is about 640 nm, the light transmittance I starts to increase at the point when the driving voltage is about 2 volts and has the maximum value at a point when the driving voltage is about 3.7 volts. When the driving voltage becomes greater than about 3.7 volts, the light transmittance I starts to decrease. In the relation between the light transmittance I and the driving voltage V according to the first reference value Δn1d1, the driving voltages V corresponding to the period, in which the light transmittance I rises from the minimum value of the light transmittance I to the maximum value of the light transmittance I, are set to the driving voltages used to drive the first liquid crystal molecules of the first liquid crystal layer LC1.

Therefore, when the Δn1d1 value is about 640 nm, the driving voltage of about 2 volts to about 3.7 volts in a second voltage period V_2 is required to drive the first liquid crystal molecules of the first liquid crystal layer LC1. That is, when the Δnd value in the second voltage period V_2 is used as the Δn1d1 value, the driving voltage used to drive the first liquid crystal molecules of the first liquid crystal layer LC1 may be decreased.

In addition, as shown in FIG. 4, when the Δn1d1 value is about 640 nm, a maximum light transmittance is more increased than when the Δnd value is about 330 nm. That is, when the Δnd value in the second period T2 is used as the Δn1d1 value, the maximum light transmittance may be high.

Figure 5:
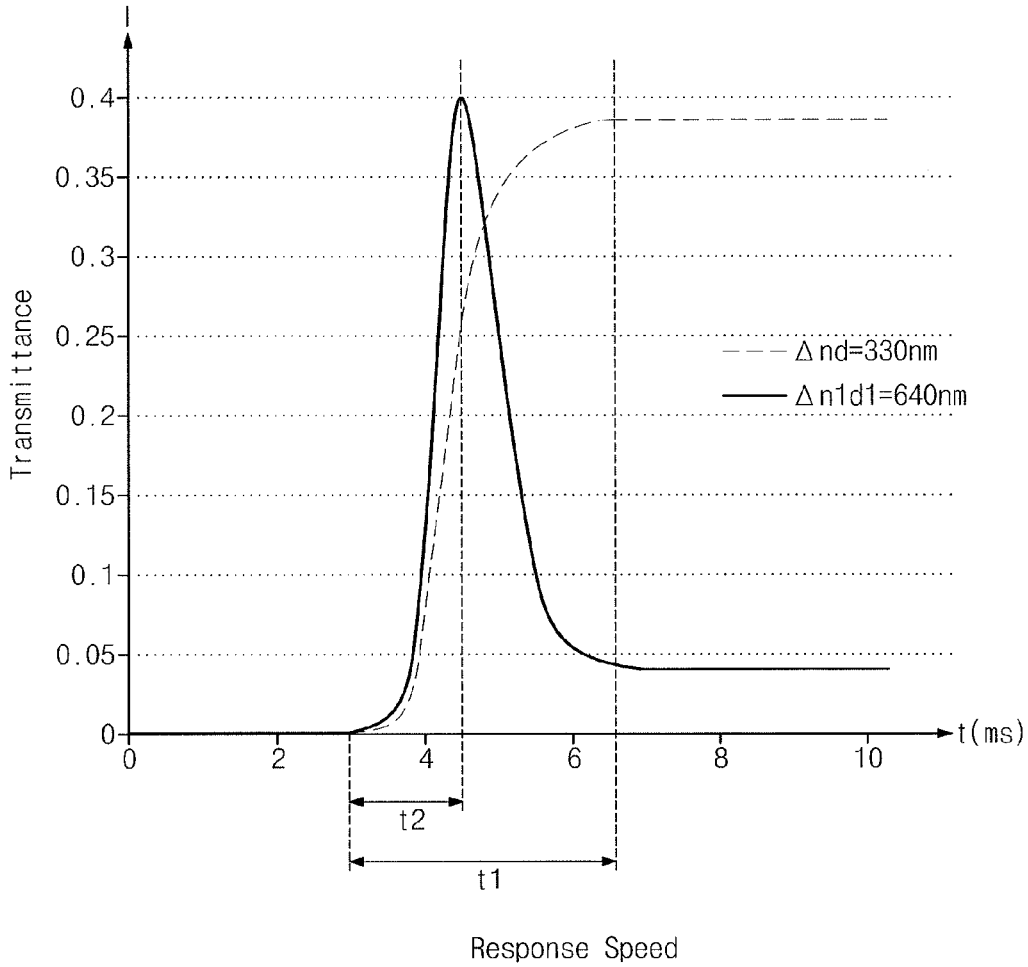
FIG. 5 illustrates a graph of light transmittance as a function of a response speed in the display apparatus according to an exemplary embodiment and in a conventional display apparatus.

FIG. 5 is a graph showing the light transmittance as a function of the response speed in the display apparatus according to an exemplary embodiment of the present disclosure and in a conventional display apparatus.

In FIG. 5, an X-axis represents the response speed of the liquid crystal and a Y-axis represents the light transmittance. A graph indicated by a dotted line in FIG. 5 shows a relation between the light transmittance and the response speed according to the conventional Δnd value, and a graph indicated by a solid line in FIG. 5 shows a relation between the light transmittance and the response speed according to the first reference value of the present exemplary embodiment.

Referring to FIG. 5, the Δnd value of about 330 nm corresponds to any one Δnd value among the Δnd values in the first period T1 shown in FIG. 3, and the Δn1d1 value of about 640 nm corresponds to any one Δnd value among the Δnd values in the second period T2 shown in FIG. 3. That is, the first reference value Δn1d1 of the present exemplary embodiment is set to about 640 nm in FIG. 5.

When the Δnd value is about 330 nm, a first time duration t1 is required to saturate the light transmittance I. In FIG. 5, the first time duration t1 is about 3.6 ms. When the Δn1d1 value is about 640 nm, a second time duration t2 is required to saturate the light transmittance I. As shown in FIG. 5, the second time duration t2 is shorter than the first time duration t1. The second time duration t2 is about 1.5 ms. Thus, when the Δnd value in the second period T2 is used as the Δn1d1 value, the response speed of the first liquid crystal may be improved.

Figure 6:
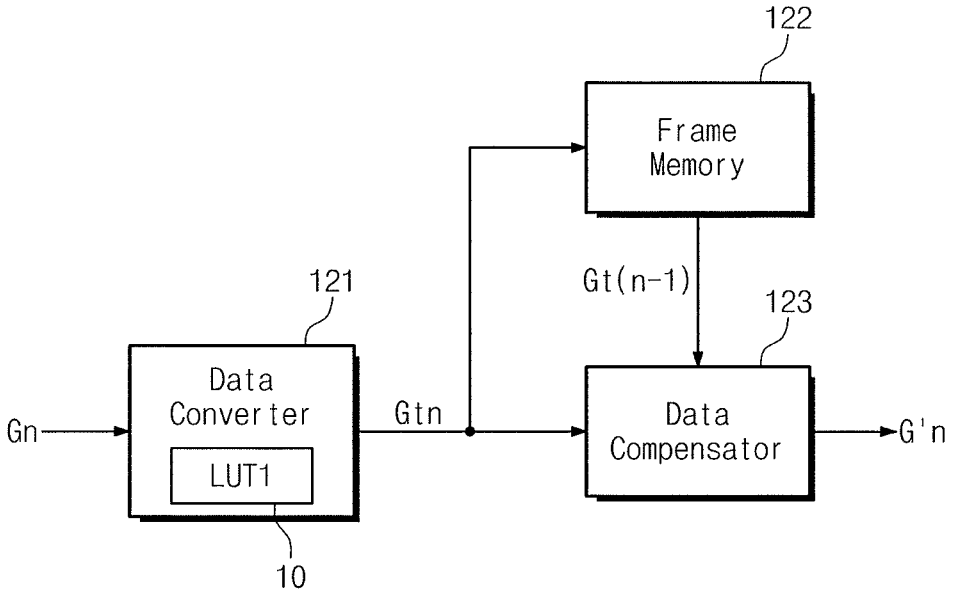
FIG. 6 illustrates a block diagram of a timing controller used to process image signals shown in FIG. 1.
Figure 7:
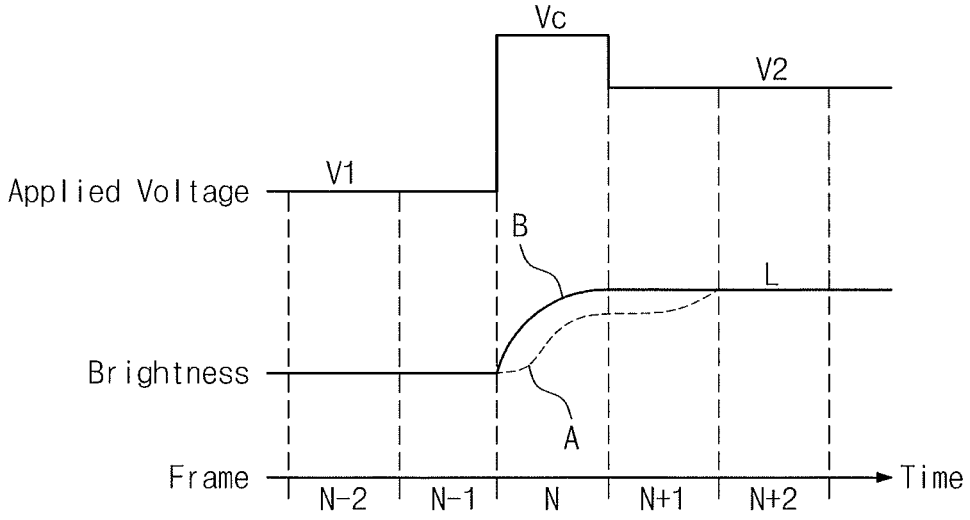
FIG. 7 illustrates a timing diagram explaining an operation of a data compensator shown in FIG. 6.

FIG. 6 is a block diagram showing the timing controller 120 used to process image signals shown in FIG. 1, and FIG. 7 is a timing diagram explaining an operation of a data compensator shown in FIG. 6.

Referring to FIG. 6, the timing controller 120 includes a data converter 121, a frame memory 122, and a data compensator 123.

The data converter 121 converts the image signals Gn to the image signals corresponding to the first reference value Δn1d1. In detail, the data converter 121 includes a first look-up table 10, i.e., LUT1 in FIG. 6. The first look-up table 10 stores gray scale values corresponding to the first reference value Δn1d1.

The gray scale values corresponding to the first reference value Δn1d1 correspond to the driving voltages in the period in which the light transmittance I rises from the minimum value of the light transmittance I to the maximum value of the light transmittance I in the relation between the light transmittance I and the driving voltage V according to the first reference value Δn1d1. For instance, when the first reference value Δn1d1 is about 640 nm, the gray scale values corresponding to the driving voltages in the second voltage period V_2 may be stored in the first look-up table 10.

The refractive index anisotropy Δn1 of the first liquid crystal and the first thickness d1 of the first liquid crystal layer LC1 are previously set when the display apparatus is manufactured. The first look-up table 10 stores the gray scale values corresponding to the first reference value Δn1d1 set by the refractive index anisotropy Δn1 of the first liquid crystal and the first thickness d1 of the first liquid crystal layer LC1.

The data converter 121 converts the image signals Gn to the image signals Gtn having the gray scale values stored in the first look-up table 10. For instance, the image signals Gtn have the gray scale values corresponding to the voltage values required to drive the first liquid crystal molecules.

When the first reference value Δn1d1 is about 640 nm and the liquid crystal layer of any one pixel PX has the light transmittance of about 4.0, the image signal Gtn is required to have the gray scale value corresponding to a voltage of about 3.7 volts. The data converter 121 converts the image signal Gn applied to the pixel PX, which is required to have the light transmittance of about 4.0, to the image signal Gtn having the gray scale value corresponding to the voltage of about 3.7 volts on the basis of the gray scale values stored in the first look-up table 10.

Accordingly, the image signal Gtn having the gray scale value corresponding to the voltage of about 3.7 volts may be converted to the data voltage with the level of about 3.7 volts by the data driver 140. In this case, the liquid crystal layer of the pixel PX applied with the data voltage having the level of about 3.7 volts may be operated to have the light transmittance of about 4.0.

The image signals Gtn having the converted gray scale values by the data converter 121 are provided to the frame memory 122 and the data compensator 123. The frame memory 122 stores image signals Gt(n−1) of a previous frame. The image signals Gt(n−1) of the previous frame have the converted gray scale values in the previous frame. The data compensator 123 receives the image signals Gt(n−1) of the previous frame from the frame memory 122.

The data compensator 123 receives the image signals Gtn of a present frame from the data converter 121. The image signals Gtn of the present frame have the converted gray scale values in the present frame.

Referring to FIG. 7, a first gray scale value of the image signals Gt(n−1) of the previous frame N−1 may correspond to a first target voltage V1, and a second gray scale value of the image signals Gtn of the present frame N may correspond to a second target voltage V2 higher than the first target voltage V1.

When a voltage difference between the first target voltage V1 and the second target voltage V2 is larger than a predetermined reference value, it is possible to reach a target brightness L in the present frame N even though the second target voltage V2 is applied to the liquid crystal. For instance, the brightness of the pixel PX does not reach the target brightness L in the present frame N and reaches the target brightness L after about two frames lapse as represented by a curve A in FIG. 7.

The data compensator 123 compares the image signals Gtn of the present frame N and the image signals Gt(n−1) of the previous frame N−1. The data compensator 123 compensates the gray scale values of the image signals Gtn of the present frame N on the basis of the compared result.

In detail, the data compensator 123 compares the first gray scale value of the image signal Gtn of the present frame N and the second gray scale value of the image signal Gt(n−1) of the previous frame N−1. The data compensator 123 compensates the gray scale value of the image signal Gtn of the present frame N when a difference value between the first gray scale value and the second gray scale value is greater than a predetermined reference value.

The image signals G'n having the gray scale value compensated by the data compensator 123 are provided to the data driver 140. The image signals G'n are provided to the data driver 140 as the image signals having the converted data format.

The voltage corresponding to the compensated gray scale value is referred to as a compensation voltage Vc. The compensated gray scale value may be greater than the second gray scale value. That is, the compensation voltage Vc has a level higher than that of the second target voltage V2.

Therefore, when the voltage difference between the first target voltage V1 and the second target voltage V2 is greater than the predetermined reference value, the first liquid crystal is over-driven to the compensation voltage Vc higher than the second target voltage V2 in the present frame N. That is, the compensation voltage Vc higher than the second target voltage V2 is applied to the liquid crystal to over-drive the pixel PX in the present frame N. As a result, a rising time is reduced, and thus the pixel PX may reach the target brightness L in the present frame N as represented by a curve B.

Due to the operation of the data compensator 123, the voltage higher than the target voltage of the present frame N is applied to the pixel PX as the compensation voltage, so that it is possible to reach the target voltage level in the present frame. In the following frames, the response speed of the first liquid crystal may be improved by applying the target voltage as the data voltage. The above-described operation of the data compensator 123 may be called a dynamic capacitance compensation (DCC) scheme.

As described above, since the Δnd value in the second period T2 is used as the first reference value Δn1d1 and the first liquid crystal is driven by the driving voltages corresponding to the first reference value Δn1d1, the response speed of the display panel 110 may be improved. In addition, the first liquid crystal is over-driven by the DCC scheme, and thus the response speed of the display panel 110 may be improved.

Figure 8:
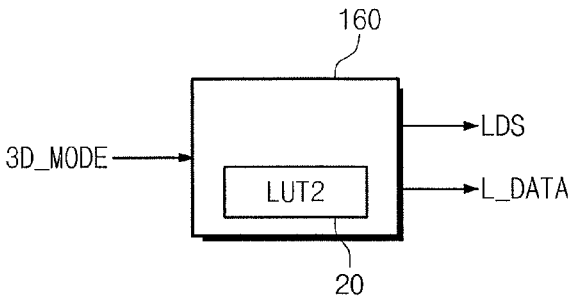
FIG. 8 illustrates a block diagram of a liquid crystal lens controller shown in FIG. 1.

FIG. 8 is a block diagram showing the liquid crystal lens controller shown in FIG. 1.

Referring to FIG. 8, the liquid crystal lens controller 160 generates a lens control signal LDS in response to the 3D mode signal, which is used to drive the liquid crystal lens panel 150 as the Fresnel lens.

The liquid crystal lens panel 150 includes a third substrate, a fourth substrate facing the third substrate, and a second liquid crystal layer interposed between the third substrate and the fourth substrate. The second liquid crystal layer includes a plurality of second liquid crystal molecules. The configuration of the liquid crystal lens panel 150 will be described in detail with reference to FIG. 9.

A response speed of the liquid crystal lens panel 150 is determined depending on a response speed of a second liquid crystal, and the response speed of the second liquid crystal is determined depending on a response speed of the second liquid crystal molecules. The response speed of the second liquid crystal is changed depending on a refractive index anisotropy Δn2 of the second liquid crystal and a second thickness d2 of the second liquid crystal layer. The refractive index anisotropy Δn2 of the second liquid crystal is determined by a difference between a refractive index ne2 in a long axis direction of the second liquid crystal molecules and a refractive index no2 in a short axis direction of the second liquid crystal molecules.

A value obtained by multiplying the refractive index anisotropy Δn2 of the second liquid crystal by the second thickness d2 of the second liquid crystal layer is referred to as a second reference value Δn2d2. That is, the second reference value may be represented by Δn2d2. Similar to the first reference value Δn1d1, the second reference value Δn2d2 may be any one value of the Δnd values in the second period T2 shown in FIG. 3.

That is, the second reference value Δn2d2 is set using the refractive index anisotropies Δn of the liquid crystal molecules and the thicknesses d of the liquid crystal layer between the first maximum value and the fifth maximum value of the sine wave of the light transmittance I according to the variation of Δnd in Equation 2. Therefore, the second reference value Δn2d2 is set to improve the response speed of the liquid crystal lens panel 150 as similar to the first reference value Δn1d1.

In addition, the driving voltages V corresponding to the period, in which the light transmittance I rises from the minimum value of the light transmittance I to the maximum value of the light transmittance I, are set to the driving voltages used to drive the second liquid crystal molecules of the second liquid crystal layer LC2 in the relation between the light transmittance I and the driving voltage V according to the second reference value Δn2d2.

The liquid crystal lens controller 160 includes a second look-up table 20, i.e., LUT2. Similar to the first look-up table 10, the second look-up table 20 includes data values corresponding to the second reference value Δn2d2. That is, the data values corresponding to the second reference value Δn2d2 correspond to the driving voltages in the period in which the light transmittance I rises from the minimum value of the light transmittance I to the maximum value of the light transmittance I in the relation between the light transmittance I and the driving voltage V according to the second reference value Δn2d2.

For instance, when the second reference value Δn2d2 is about 640 nm, the data values corresponding to the voltages in the second voltage period V_2 may be stored in the second look-up table 20.

The second reference value Δn2d2 may be set to the same value as the first reference value Δn1d1, but it should not be limited thereto or thereby. That is, the second reference value Δn2d2 may be set to the value different from the first reference value Δn1d1. For instance, the refractive index anisotropy Δn1 of the first liquid crystal may have the same value as the refractive index anisotropy Δn2 of the first liquid crystal and the second thickness d2 of the second liquid crystal layer may be larger than the first thickness d1 of the first liquid crystal layer LC1.

The liquid crystal lens controller 160 generates lens data signals L_DATA on the basis of the data values stored in the second look-up table 20 to drive the second liquid crystal layer as the Fresnel lens. In addition, the liquid crystal lens controller 160 generates the lens control signal LDS and applies the lens control signal LDS to the lens driver 170.

The lens driver 170 converts the lens data signals L_DATA to the lens driving voltages in response to the lens control signal LDS and applies the lens driving voltages to the liquid crystal lens panel 150. The liquid crystal lens panel 150 is operated as the Fresnel lens by the lens driving voltages.

As described above, since the Δnd value in the second period T2 is used as the second reference value Δn2d2 and the second liquid crystal is driven by the driving voltages corresponding to the second reference value Δn2d2, the response speed of the liquid crystal lens panel 150 may be improved.

Figure 9:
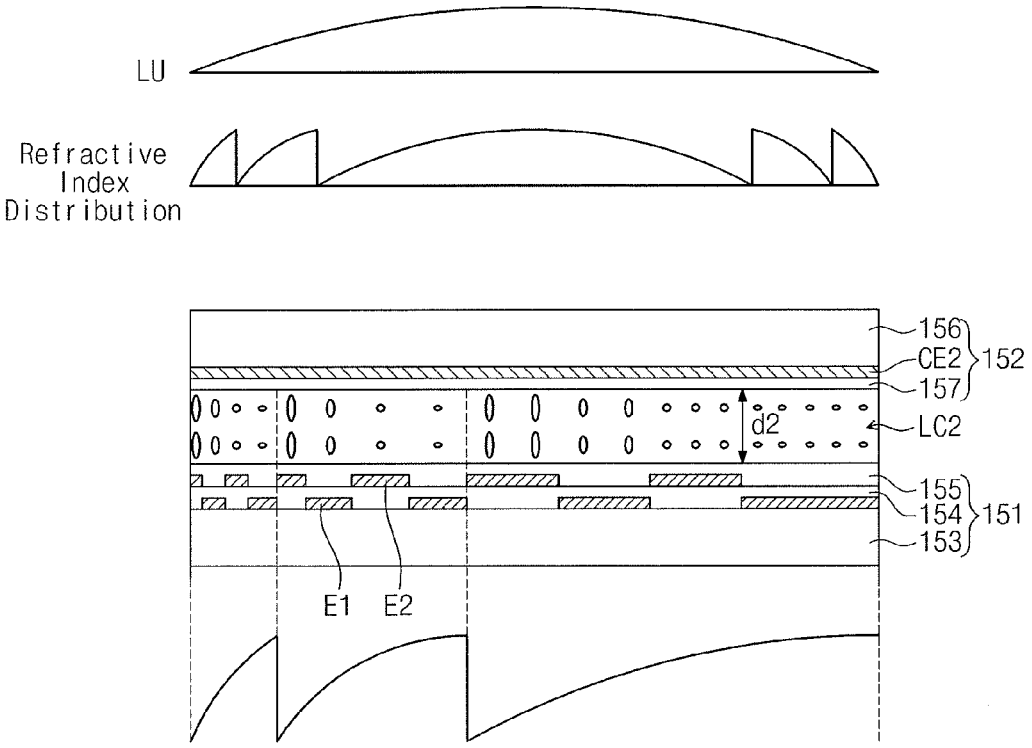
FIG. 9 illustrates a cross-sectional view of a liquid crystal lens panel shown in FIG. 1.

FIG. 9 is a cross-sectional view showing the liquid crystal lens panel shown in FIG. 1.

For the convenience of explanation, FIG. 9 shows a portion of the liquid crystal lens panel 150 together with a lens unit LU and a refractive index distribution of the lens unit LU. Although not shown in figures, the lens unit LU may extend in the same direction as the direction in which the data lines extend.

Referring to FIG. 9, the liquid crystal lens panel 150 includes a third substrate 151, a fourth substrate 152 disposed to face the third substrate 151, a second liquid crystal layer LC2 interposed between the third substrate 151 and the fourth substrate 152. The second thickness d2 of the second liquid crystal layer LC2 corresponds to a distance d2 between the third substrate 151 and the fourth substrate 152.

The third substrate 151 includes a third base substrate 153, a plurality of first electrodes E1, a third insulating layer 154, a plurality of second electrodes E2, and a fourth insulating layer 155. The first electrodes E1 are alternately arranged with and disposed on a different layer from the second electrodes E2.

In detail, the first electrodes E1 are disposed on the third base substrate 153. The third insulating layer 154 is disposed on the third base substrate 153 to cover the first electrodes E1. The second electrodes E2 are disposed on the third insulating layer 154 and alternately arranged with the first electrodes E1. The fourth insulating layer 155 is disposed on the third insulating layer 154 to cover the second electrode E2.

When the display apparatus 100 displays the 3D image, the lens driving voltages required to drive the lens unit LU as the Fresnel lens are applied to the first electrodes E1 and the second electrodes E2.

The fourth substrate 152 includes a fourth base substrate 156, a second common electrode CE2, and a fifth insulating layer 157. The second common electrode CE2 is disposed on the fourth base substrate 156. The fifth insulating layer 157 is disposed on the second common electrode CE2. The second common electrode CE2 is applied with the second common voltage Vcom2.

The lens driving voltages are applied to the first electrodes E1 and the second electrodes E2, and the second common electrode CE2 is applied with the second common voltage Vcom2. The second liquid crystal layer LC2 is operated as the Fresnel lens by the voltage difference between the second common voltage Vcom2 and the lens driving voltages. For instance, the second liquid crystal molecules of the second liquid crystal LC2 are driven to have the refractive index distribution of the Fresnel lens.

Figure 10:
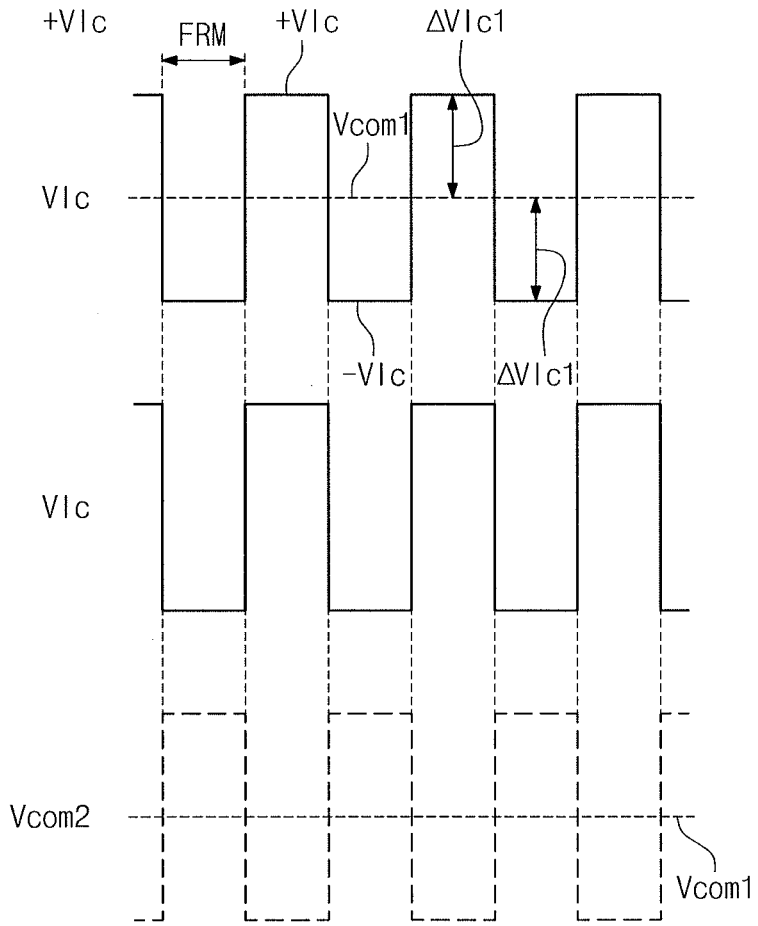
FIG. 10 illustrates a waveform diagram of a lens driving voltage applied to the liquid crystal lens panel and a second common voltage.
Figure 11:
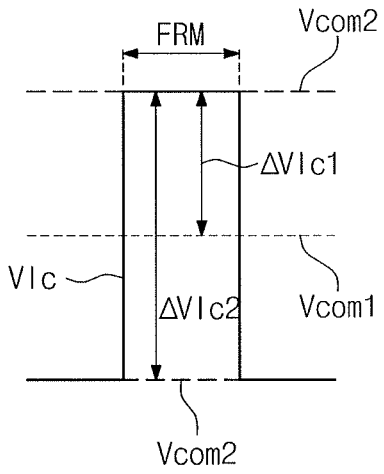
FIGS. 11 and 12 illustrate diagrams of a voltage difference between the lens driving voltage and the second common voltage.
Figure 12:
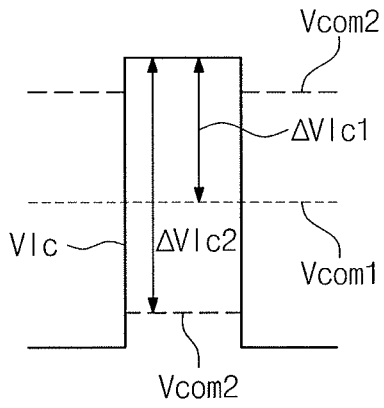

FIG. 10 is a waveform diagram showing the lens driving voltage applied to the liquid crystal lens panel, and the second common voltage and FIGS. 11 and 12 are views showing the voltage difference between the lens driving voltage and the second common voltage.

Referring to FIGS. 10, 11, and 12, the lens driving voltages Vlc having a polarity inverted every frame are applied to the first and second electrodes E1 and E2.

The first common voltage Vcom1 having the direct current voltage level may be applied to the second common electrode CE2. In this case, an absolute value of the voltage difference between the lens driving voltages Vlc and the common voltage Vcom is defined as a first voltage value ΔVlc1. The second liquid crystal molecules of the second liquid crystal layer LC2 may be driven by the first voltage value ΔVlc1. However, liquid crystals having a slow response speed may not be driven to a desired angle in the present frame even though the first voltage value ΔVlc1 is applied.

As shown in FIG. 10, however, the second common voltage Vcom2 may be a square wave with an opposite polarity to the lens driving voltages. As shown in FIG. 11, an absolute value of the voltage difference between the second common voltage Vcom2 and the lens driving voltages Vcl is defined as a second voltage value ΔVlc2. The second voltage value ΔVlc2 is larger than the first voltage value ΔVlc1.

As shown in FIGS. 10 and 11, an absolute value of the lens driving voltages Vlc may be equal to an absolute value of the second common voltage Vcom2, but they should not be limited thereto or thereby. That is, the absolute value of the lens driving voltages Vlc may be different from the absolute value of the second common voltage Vcom2 as shown in FIG. 12.

Although the absolute value of the lens driving voltages Vlc is different from the absolute value of the second common voltage Vcom2, the second voltage value ΔVlc2 is greater than the first voltage value ΔVlc1 as shown in FIG. 12 since the second common voltage Vcom2 is the square wave having the opposite polarity to the lens driving voltages Vlc.

When the second liquid crystal molecules are driven by the second voltage value ΔVlc2, the second liquid crystal may be driven to the desired angle by the second voltage value ΔVlc2 in the present frame as similar to the above-mentioned DCC scheme. Thus, the response speed of the second liquid crystal may be improved.

As described above, since the Δnd value in the second period T2 is used as the second reference value Δn2d2, and the second liquid crystal is driven by the lens driving voltages corresponding to the second voltage value Δn2d2, the response speed of the liquid crystal lens panel 150 may be improved. In addition, the second liquid crystal is driven by the second voltage value ΔVlc2, and thus the response speed of the liquid crystal lens panel 150 may be improved.

According to the above-mentioned operation of the display apparatus 100, since the response speed of the display panel 110 and the liquid crystal lens panel 150 is improved, the response speed of the display apparatus 100 is improved. Consequently, the response speed of the display apparatus 100 may be improved.

Figure 13:
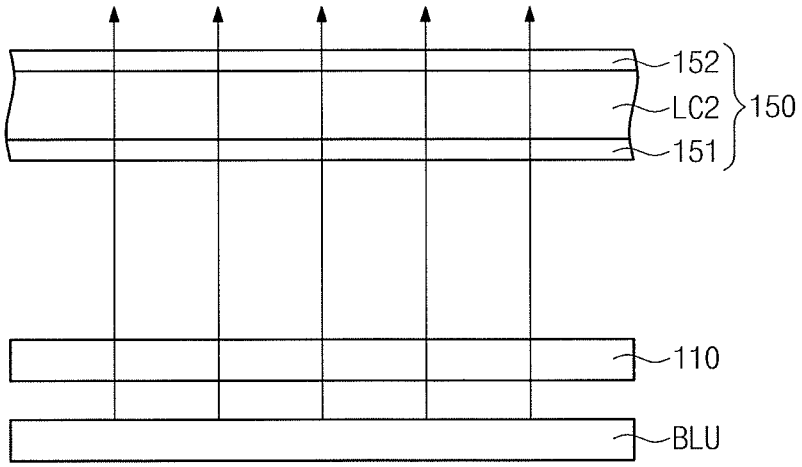
FIGS. 13 and 14 illustrate diagrams of light refracted by an arbitrary liquid crystal lens of the liquid crystal lens panel of the display apparatus shown in FIG. 1.
Figure 14:
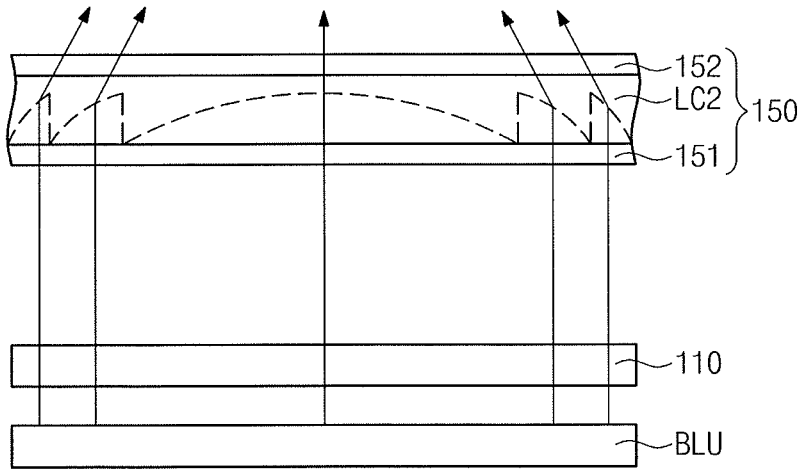

FIGS. 13 and 14 are views showing the light refracted by an arbitrary liquid crystal lens of the liquid crystal lens panel of the display apparatus shown in FIG. 1.

In detail, FIG. 13 shows the light refracted by the liquid crystal lens panel 150 of the display apparatus 100 operated in the 2D mode, and FIG. 14 shows the light refracted by the liquid crystal lens panel 150 of the display apparatus 100 operated in the 3D mode.

Referring to FIGS. 13 and 14, the backlight unit BLU provides the light to the display panel 110, and the display panel 110 controls the transmittance of the light, thereby displaying the desired image.

The liquid crystal lens panel 150 is operated in the 2D or 3D mode. In more detail, when the display apparatus 100 is operated in the 2D mode, the lens driving voltages are not applied to the liquid crystal lens panel 150. Accordingly, the liquid crystal lens panel 150 transmits the light from the display panel 110 without substantial alteration as shown in FIG. 13. Therefore, the viewer perceives the 2D image.

When the display apparatus 100 is operated in the 3D mode, the lens driving voltages are applied to the first and second electrodes E1 and E2, and the second common voltage Vcom2 is applied to the second common voltage CE2.

The second liquid crystal molecules of the second liquid crystal layer LC2 are aligned to have an optical path distribution corresponding to the Fresnel lens as indicated by a dotted line in FIG. 14. That is, the liquid crystal lens panel 150 is operated as the Fresnel lens.

The liquid crystal lens panel 150 operated as the Fresnel lens refracts the image light provided from the display panel 110 as the Fresnel lens. Accordingly, the left-eye image and the right-eye image are provided to the viewer, and thus the viewer perceives the 3D image.

Example embodiments have been disclosed herein, and although specific terms are employed, they are used and are to be interpreted in a generic and descriptive sense only and not for purpose of limitation. Accordingly, it will be understood by those of skill in the art that various changes in form and details may be made without departing from the spirit and scope of the present invention as set forth in the following claims.

What is claimed is:

1. A display apparatus, comprising:

a display panel including a first liquid crystal layer, the display panel to generate an image;

a timing controller to convert first image signals to second image signals which have gray scales corresponding to a first reference value, and to compensate the second image signals to generate third image signals to overdrive the first liquid crystal layer, the first reference value based on a product of a refractive index anisotropy of a first liquid crystal of the first liquid crystal layer and a first thickness of the first liquid crystal layer;

a first driver to convert the third image signals to data voltages, and to apply the data voltages to the first liquid crystal layer to drive the first liquid crystal layer;

a liquid crystal lens panel including a second liquid crystal layer to receive image light and to refract the image light;

a liquid crystal lens controller to generate lens data signals using data values corresponding to a second reference value, the second reference value based on a product of a refractive index anisotropy of a second liquid crystal of the second liquid crystal layer and a second thickness of the second liquid crystal layer; and a second driver to convert the lens data signals to lens data voltages and to apply the lens data voltages to the second liquid crystal layer to drive the second liquid crystal layer.

2. The display apparatus as claimed in claim 1, wherein:

the first reference value is set based on a refractive index anisotropy of the first liquid crystal and a thickness of the first liquid crystal layer, the second reference value is set based on a refractive index anisotropy of the second liquid crystal and a thickness of the second liquid crystal layer, the first and second reference values exist between a first maximum value and a fifth maximum value of a sine wave of a light transmittance through respective ones of the first and second liquid crystal layers according to a variation of Δnd, the light transmittance through respective ones of the first and second liquid crystal layers based on the relationship below:

$$I \propto \sin^2((\pi \Delta n d)/\lambda)$$

where I denotes the light transmittance, Δn denotes a refractive index anisotropy of the liquid crystal, d denotes the thickness of the liquid crystal layer, denotes a wavelength of the light, the Δn is obtained by subtracting "no" from "ne" "ne" denotes a refractive index in a long axis of liquid crystal molecules, and "no" denotes a refractive index in a short axis of the liquid crystal molecules.

3. The display apparatus as claimed in claim 2, wherein the first reference value has a same value as the second reference value, and the second thickness is larger than the first thickness.

4. The display apparatus as claimed in claim 2, wherein the gray scale values corresponding to the first reference value correspond to driving voltages in a period in which the light transmittance rises from a minimum value to a maximum value in a relation between the light transmittance and the driving voltages according to the first reference value.

5. The display apparatus as claimed in claim 4, wherein the timing controller includes:

a data converter that converts the first image signals to the second image signals, such that the second image signals have the gray scale values corresponding to the first reference value;

a frame memory that stores the second image signals of a previous frame; and a data compensator that compares first gray scale values of the second image signals in a present frame with second gray scale values of the second image signals of the previous frame to compensate the first gray scale values, and the data compensator compensates the gray scale values when a difference value between the first gray scale values and the second gray scale values is greater than a predetermined reference value.

6. The display apparatus as claimed in claim 5, wherein the data converter includes a first look-up table to store the gray scale values corresponding to the first reference value.

7. The display apparatus as claimed in claim 2, wherein the display panel further comprises:

a first substrate that includes a plurality of pixels including a plurality of pixel electrodes; and a second substrate disposed to face the first substrate and including a first common electrode, the first liquid crystal layer being disposed between the first substrate and the second substrate, the data voltages being applied to the pixel electrodes, and the first common electrode being applied with a first common voltage having a predetermined direct current voltage level.

8. The display apparatus as claimed in claim 7, wherein the first driver includes:

a gate driver that generates gate signals; and a data driver that converts the third image signals to the data voltages, and the pixels receive the data voltages in response to the gate signals.

9. The display apparatus as claimed in claim 7, wherein the data voltages corresponding to the second reference value correspond to the driving voltages in a period in which the light transmittance rises from a minimum value to a maximum value in a relation between the light transmittance and the driving voltages according to the second reference value.

10. The display apparatus as claimed in claim 9, wherein the liquid crystal lens controller includes a second look-up table to store the data values corresponding to the second reference value.

11. The display apparatus as claimed in claim 7, further comprising a voltage generator to generate a first common voltage and a second common voltage, wherein the second common voltage is applied to the liquid crystal lens panel based on a control signal from the liquid crystal lens controller.

12. The display apparatus as claimed in claim 11, wherein the lens driving voltages have a polarity inverted every frame, and the second common voltage has an opposite polarity to the lens driving voltages.

13. The display apparatus as claimed in claim 12, wherein a difference value between the second common voltage and the lens driving voltage is larger than a difference value between the first common voltage and the lens driving voltage in every frame.

14. The display apparatus as claimed in claim 12, wherein an absolute value of the lens driving voltages is equal to an absolute value of the second common voltage.

15. The display apparatus as claimed in claim 12, wherein an absolute value of the lens driving voltages is different from an absolute value of the second common voltage.

16. The display apparatus as claimed in claim 12, wherein the liquid crystal lens panel further comprises:

a third substrate that includes a plurality of first electrodes and a plurality of second electrodes alternately arranged with and disposed on a different layer from the first electrodes; and a fourth substrate disposed to face the third substrate and including a second common electrode, the second liquid crystal layer being disposed between the third substrate and the fourth substrate, the first and second electrodes being applied with the lens driving voltages, and the second common electrode being applied with the second common voltage.

17. The display apparatus as claimed in claim 16, wherein the second liquid crystal layer is operated as a Fresnel lens by the lens driving voltages and the second common voltage.

* * * * *